US005351279A

United States Patent [19]

She et al.

[11] Patent Number: 5,351,279

[45] Date of Patent: Sep. 27, 1994

[54] X-RAY MICROSCOPE WITH A DIRECT CONVERSION TYPE X-RAY PHOTOCATHODE

[75] Inventors: Yongzheng She; Shizheng Chen, both of Shanghai, China; Weilou Cao; Yanhua Shih, both of Ellicott City, Md.

[73] Assignee: CSL Opto-Electronics Corporation, Ellicott City, Md.

[21] Appl. No.: 143,091

[22] Filed: Oct. 25, 1993

Related U.S. Application Data

[62] Division of Ser. No. 937,213, Aug. 28, 1992, Pat. No. 5,285,061.

[51] Int. Cl.[5] ..... G21K 7/00

[52] U.S. Cl. ..... 378/43; 378/206

[58] Field of Search ..... 378/43, 206

[56] References Cited

U.S. PATENT DOCUMENTS 3,818,233 6/1974 Rabodzei et al. ..... 378/43

*Primary Examiner*—Craig E. Church

*Attorney, Agent, or Firm*—Whitham, Curtis, Whitham & McGinn

[57] ABSTRACT

A direct conversion X-ray photo-electron cathode has specially designed secondary electron emission layers which provides high efficiency, low noise, high speed and broad band X-ray photon detection. The X-ray photocathode is integrated with a micro channel plate and an output phosphor display screen to form a panel type X-ray intensifier. The X-ray intensifier is combined with a micro-focus X-ray source to provide projection type X-ray microscope for use in X-ray microscopic diagnostic applications.

2 Claims, 2 Drawing Sheets

X-RAY MICROSCOPE WITH A DIRECT CONVERSION TYPE X-RAY PHOTOCATHODE

CROSS REFERENCE TO RELATED APPLICATION

This application is a division of application Ser. No.07/937,213 filed Aug. 28, 1992, and allowed on Sep. 3, 1993, now U. S. Pat. No. 5,285,061.

BACKGROUND OF THE INVENTION

1. Field of the Invention

The present invention generally relates to X-ray image intensifiers and, more particularly to an X-ray microscope utilizing a direct conversion X-ray photocathode in conjunction with an electron multiplier.

2. Description of the Prior Art

X-ray to visible converters are well known in the art but generally use indirect conversion techniques, where an X-ray image is converted to visible light in a scintillator, the visible light (photons) are then converted to a corresponding electron image, and the electrons are multiplied and strike a phosphor display screen to provide an enhanced directly viewable visible image. There are numerous disadvantages in having to convert an X-ray image to a visible light image before generating and multiplying a corresponding electron image. Conversion of an X-ray image to a visible light image is normally accomplished by using a scintillator, as described in U.S. Pat. Nos. 4,104,516, 4,040,900, 4,255,666, and 4,300,046. In each instance, the scintillator exhibits a limited response time, poor spacial resolution and sensitivity, and due to the complicated fabrication techniques and the attendant requirement to use light shielding, the cost is prohibitive.

In panel type X-ray image intensifiers, scintillation noise also becomes a problem, which mostly comes from the exponential pulse height distribution of the micro channel plate (MCP) gain.

SUMMARY OF THE INVENTION

It is therefore an object of the present invention to provide a photo-electron cathode, having specially designed secondary electron emission layers, which will directly convert an X-ray image to an equivalent electron image, while exhibiting high efficiency, low noise, high speed and a broad band x-ray photon detection capability.

The shortcomings of the prior art have been effectively overcome by designing a direct conversion X-ray photo-electron cathode consisting of a heavy metal layer which functions as an X-ray absorber, and a transmission secondary electron emission layer which functions as an electron multiplier with a multiplication factor of twenty or more. It has been found that by increasing the number of input electrons per channel of the MCP by a factor of twenty or more, the scintillation noise is drastically reduced. In the instant case, this is accomplished by using a compound multiplier, which is a direct conversion type X-ray photocathode consisting of two parts. The first being a heavy metal layer, which acts as an X-ray absorber, and the second part being a transmission secondary electron emission layer. The high energy photoelectrons produced in the heavy metal layer are multiplied by the secondary electron emitter to a factor of twenty or more. Due to this design, the noise of the intensifier is reduced and the sensitivity of the X-ray photocathode is increased, especially in the high energy, X-ray region.

A new panel type X-ray intensifier may be made by integrating this new direct conversion X-ray cathode, a micro channel plate and an output display fluorescent screen.

A portable projection type X-ray microscope may be made by using the above X-ray intensifier, a microfocus X-ray source and a personal computer (PC) based image processing system. The energy of the X-ray can be adjusted and the magnification can be changed by adjusting the distance between the X-ray source and the object. The low noise and high sensitivity of the intensifier make it possible to achieve a large magnification. A sub-micron X-ray microscope has also been designed for sub-micron X-ray diagnostic purposes.

According to the invention, there is provided a photo-electron cathode, for use in an X-ray microscope, capable of directly converting an X-ray image to an equivalent electron image which shows a substantially improved sensitivity and a very low scintillation noise in the high energy X-ray region of the frequency spectrum.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
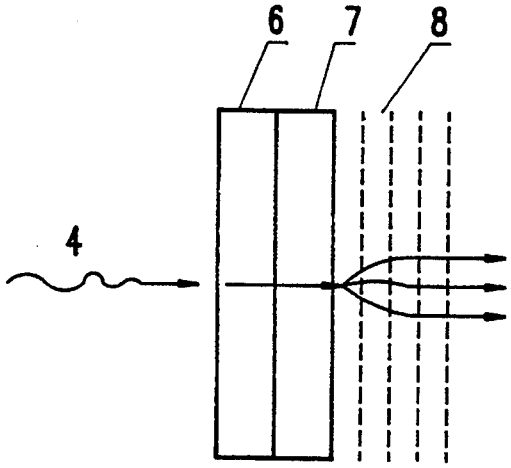
FIG. 1 shows the direct conversion compound X-ray photo-electron cathode of this invention.

Referring now to the drawings, and more particularly to FIG. 1, there is shown a diagram of the X-ray photocathode. Element 6 is a substrate of light metal, such as aluminum. The thickness is selected to assure its withstanding the attraction force from the high static electric field and does not attenuate the X-ray intensity significantly. For 35–80 KV X-ray, a 50 μm aluminum foil is suitable. Element 7 is the heavy metal layer of the X-ray photocathode, which is a layer of tantalum, tungsten, lead, bismuth, or gold. The optimum thickness depends on the energy of the X-ray photon, the L or K series critical excitation voltage and the density of the heavy metal. Table 1 gives the optimum thickness of different heavy metals for 35–80 KV X-ray.

TABLE 1

OPTIMUM THICKNESS OF DIFFERENT HEAVY METALS.

| Energy of X-Ray (KV) | 35 | 40 | 45 | 50 | 60 | 65 | 70 | 80 |
|---|---|---|---|---|---|---|---|---|
| Optimum Thickness (μm) | | | | | | | | |
| W | 0.50 | 0.70 | 0.95 | 1.2 | 1.9 | 2.3 | | |
| Ta | 0.40 | 0.85 | 1.1 | 1.5 | 2.2 | 2.7 | | |
| Au | 0.40 | 0.60 | 0.80 | 1.1 | 1.7 | | 2.5 | 3.4 |
| Pb | 0.65 | 1.0 | 1.5 | 2.0 | 3.2 | | 4.7 | 6.4 |
| Bi | 0.6 | 0.9 | 1.4 | 1.9 | 3.1 | | 4.6 | 6. |

TABLE 1-continued

| OPTIMUM THICKNESS OF DIFFERENT HEAVY METALS. | | | | | | | | |
|---|---|---|---|---|---|---|---|---|
| Energy of X-Ray (KV) | 35 | 40 | 45 | 50 | 60 | 65 | 70 | 80 |
| | 0 | 5 | | | | | | 2 |

Element 8 is the transmission secondary electron emission layer of the X-ray photocathode, which comprises one of the following materials which have a high secondary electron emission coefficient: CsI, CsBr, KCl, CsCl or MgO. The cesium iodide or cesium bromide layer can be coated in high vacuum for a high density profile, or in certain pressure of inert gas, such as argon, for a low density profile. The optimum thickness of the cesium iodide or cesium bromide layer depends on the energy of the photoelectron produced in the heavy metal layer which is determined by the selection of the X-ray energy and the specific heavy metal. For 60 KV X-ray and gold layer, the optimum thickness of the cesium iodide layer is approximately 7.4 μm for high density profile and 370 μm for low density profile, respectively. For the other heavy metals, the optimum thickness of the normal and low density alkali halides, respectively, in μms would be as follows: Bi-6.8/340, Ta-8.2/410, Pb-7.0/350, and W-8.1/405. The secondary electron conduction (SEC) gain of a low density profile cesium iodide layer can be as high as 100. The low density profile of a cesium iodide or cesium bromide layer can be prepared by evaporating the bulk material in argon with pressure of about 2 torr, the resulting relative density of the layer is about 2%. A cesium iodide secondary electron emission layer is also coated on the input channel wall of the MCP. This emission layer has a high density sub-layer and a low density sub-layer. The high density sub-layer is 1–2 μm with density of approximately 50%. The low density sub-layer has a decreased density profile from the interface with the high density sub-layer to its emission surface. The density distribution profile starts from 50% at the interface and decreases to about 2% at the emission surface. The low density sub-layer is about 3–7 μm.

Figure 2:
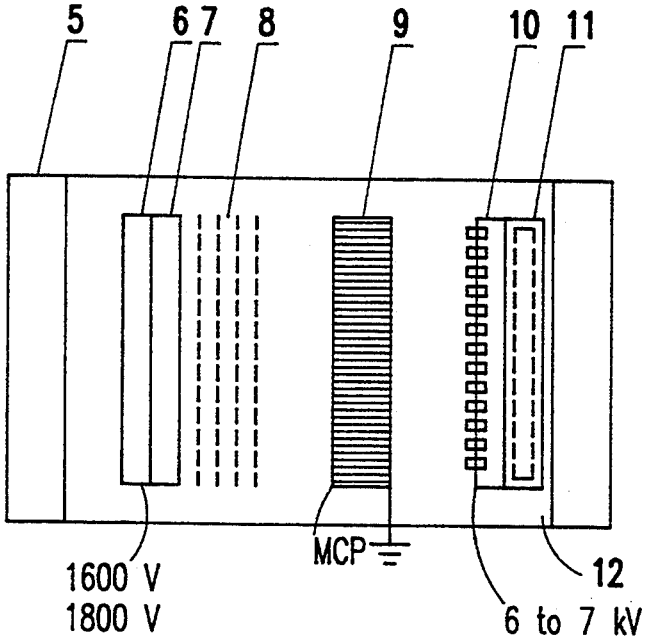
FIG. 2 shows a schematic diagram of a panel type X-ray image intensifier.

FIG. 2 is a schematic diagram of a panel type X-ray image intensifier, with element 5 being an input window. The window is made of 0.2 mm titanium foil. The thin Ti foil reduces the scattering of the incident X-ray and has an excellent transmission coefficient, especially for low energy X-rays. Element 9 is an MCP and element 10 is an output display fluorescent screen coated on a glass window 11. In operation, the voltage of the substrate 6 rages between −1500 V and −2000 V, with the voltage of the input surface of the MCP at about −1000 V and with the output surface of the MCP grounded (V=0), the voltage of the output display fluorescent screen should be around +8000 V to +10000 V. The brightness of the image can be as high as 20 Cd/m$^2$. The diameter of the panel type X-ray image intensifier can be made from 50 mm to 200 mm with the thickness of the intensifier about 2 cm. This panel type X-ray intensifier has a 1:1 input and output image ratio and is vacuumed to $5\times10^{-7}$ torr in a glass or ceramic shell.

Figure 3:
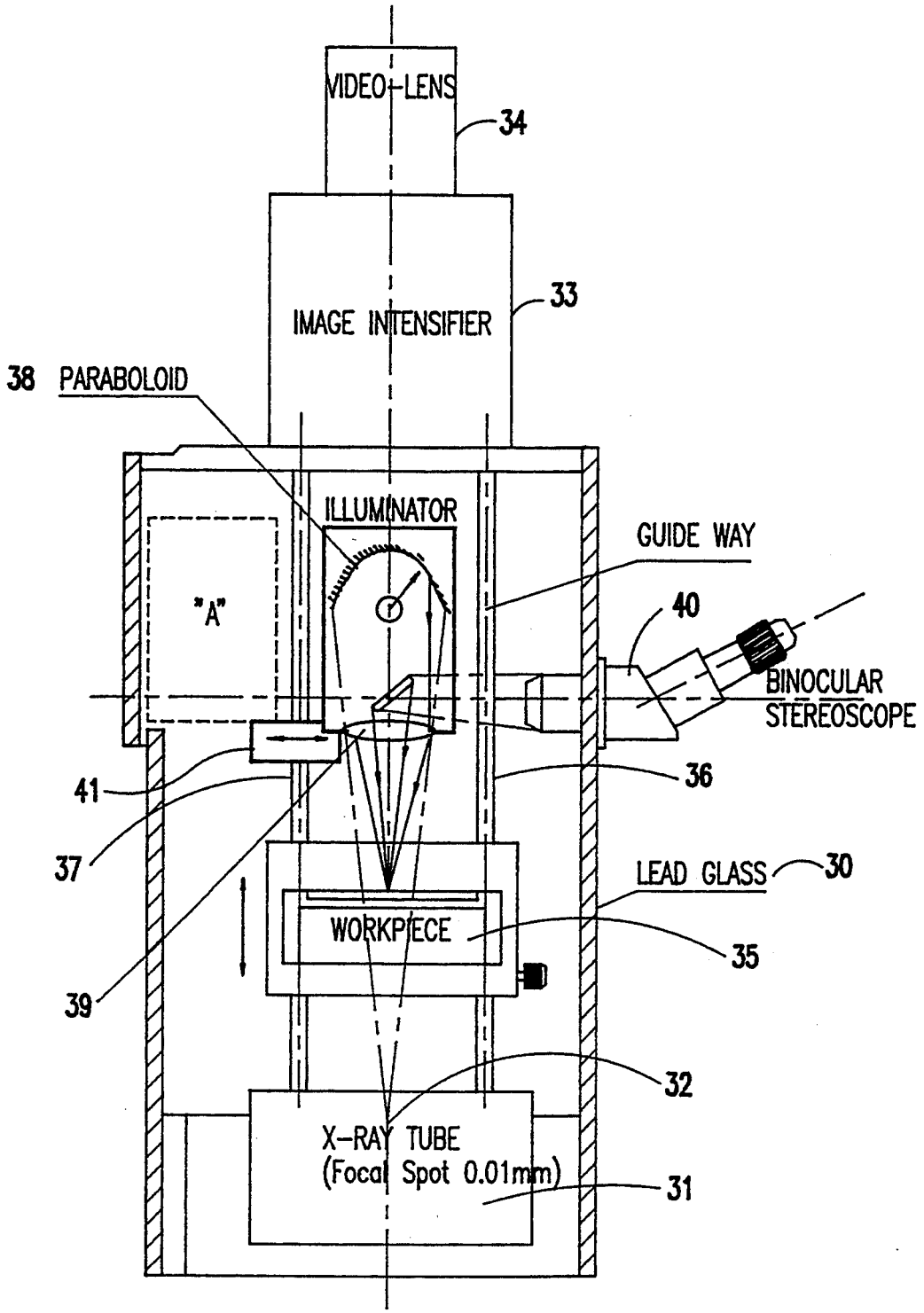
FIG. 3 depicts a portable projection type real time X-ray microscope incorporating the X-ray photocathode of FIG. 1.

FIG. 3 depicts a portable projection type real time X-ray microscope encased in a lead glass enclosure 30. An X-ray source, shown as X-ray tube 31 is mounted in one end of the enclosure and provides a 35 KV to 80 KV X-ray beam with a spot size falling between a micron and a sub-micron, as shown emanating from point 32. On the opposite end of the enclosure 30 is mounted an X-ray image intensifier 33, as described in FIG. 2, and is separated therefrom by about 300 mm to 1,000 mm, depending on the specific application. The videocamera 34 actually represents the means for viewing the X-ray image presented at the output of the image intensifier and can be either directly viewed or recorded by video. A vertically adjustable workpiece 35 is mounted on a pair of transport rails 36 and 37 for adjusting the position of the item under study. The geometrical amplification is therefore adjustable continuously from 1 to 1.000 times. A parabolic illuminator 38, shown in optical alignment with the X-ray tube 32 and the image intensifier 33 is initially used for aligning the object on workpiece 35 to be X-rayed. The co-axial optical microscope 40 and lens 39 are used for viewing the alignment of the object under test, and after optically aligning the workpiece, the illuminator 38 and lens 39 will be moved, by illuminator moving means 41 out of the optical alignment path to position "A" during the X-ray test.

Having thus described our invention, what we claim as new and desire to secure by Letters Patent is as follows:

1. A portable projection type real time X-ray microscope, comprising:

an X-ray source having a micron focal spot size;

a workpiece for holding an item to be investigated;

an X-ray direct conversion type image intensifier;

a movable parabolic illuminator in optical alignment with the X-ray image intensifier, for optically aligning the X-ray image intensifier with the object under investigation on the test workpiece, whereby upon moving the illuminator out of the alignment path of the X-ray source the X-ray test may be conducted on the test object;

illuminator moving means for moving the illuminator out of the alignment path during X-ray testing of the test object;

adjustment means for vertically moving said workpiece between the X-ray source and the parabolic illuminator for controlling the magnification of the X-ray image.

2. The X-ray microscope of claim 1, further including a co-axial optical microscope for aligning an object under test.

* * * * *